US005374986A

United States Patent [19]

Solinsky

[11] Patent Number: 5,374,986

[45] Date of Patent: Dec. 20, 1994

[54] AUTOMATED BORESIGHTING DEVICE AND METHOD FOR AN AIMING LIGHT ASSEMBLY

[75] Inventor: Kenneth S. Solinsky, Bedford, N.H.

[73] Assignee: Insight Technology Incorporated, Londonderry, N.H.

[21] Appl. No.: 115,024

[22] Filed: Sep. 2, 1993

[51] Int. Cl.[5] ..... G02B 27/34

[52] U.S. Cl. ..... 356/4; 89/41.17; 33/241; 356/252

[58] Field of Search ..... 356/4, 252, 247, 253, 356/254, 255; 89/28.2, 41.17, 41.19; 42/100, 103; 33/233, 241, 275 R

[56] References Cited

U.S. PATENT DOCUMENTS

| | | | |
|---|---|---|---|
| 3,742,636 | 7/1973 | Dealy et al. . | |
| 4,281,993 | 8/1981 | Shaw . | |
| 4,993,833 | 2/1991 | Lorey et al. | 356/252 |
| 5,026,158 | 6/1991 | Golubic . | |
| 5,031,349 | 7/1991 | Vogel | 92/103 |
| 5,090,805 | 2/1992 | Stewarz | 356/251 |
| 5,118,186 | 6/1992 | Schrätzenstaller et al. | 356/153 |
| 5,221,956 | 6/1993 | Patterson et al. | 356/28 |
| 5,249,501 | 10/1993 | Waldman et al. | 89/41.06 |

*Primary Examiner*—Mark Hellner
*Attorney, Agent, or Firm*—Baker & Botts

[57] ABSTRACT

An automated boresighting device and method for an aiming light assembly. The device comprises a housing attached to the weapon, aiming means enclosed in the housing for generating a beam in a direction whereby an operator may aim the weapon at a target, range determination means enclosed in the housing for determining the range from the weapon to the target, ballistic trajectory data enclosed in the housing for use in calculating device elevation angle as a function of range, and automatic adjusting means for automatically adjusting the aiming means responsive to computed elevation determined by the range determination means. The adjusting means includes a computer and the servo assembly. The computer may use the range determination information and ballistic trajectory information determined by a ballistic trajectory means to determine an elevation angle adjustment necessary for a given range. A servo assembly automatically adjusts the transmitter in response to the computed angle.

16 Claims, 3 Drawing Sheets

AUTOMATED BORESIGHTING DEVICE AND METHOD FOR AN AIMING LIGHT ASSEMBLY

FIELD OF THE INVENTION

The invention relates generally to aiming light assemblies and more particularly to improvements in the boresighting of aiming light assemblies.

BACKGROUND OF THE INVENTION

In general, aiming light assemblies which are used to assist in aiming a weapon are well known. Typically, an aiming light assembly is connected to a weapon and is used to generate an aiming beam (visible or invisible) which may be directed at a target to assist in aiming the weapon. A number of types of aiming lights are known, including, for example, visible laser aiming lights and infrared lights which are used with night vision goggles. An example of an aiming light assembly is disclosed in commonly owned U.S. application Ser. No. 07/957,916 entitled "Aiming Light Assembly and Mounting Therefor." FIGS. 1 and 1*a* of the present application show an example of such an aiming light assembly. For effective operation, once mounted to the weapon, the aiming light assembly must be boresighted, or zeroed. The process of boresighting, or zeroing, per se, is well known.

Generally speaking, boresighting refers to the process of aligning the aiming beam so that it coincides with the actual target area of the weapon for a given distance, i.e. the area where ammunition fired from the weapon will impact the target. Due to the ballistic trajectory of ammunition fired from a weapon, boresighting typically must be performed for a particular target distance or range. In the past, this has been primarily accomplished by manual adjustment of the aiming beam, for example, in vertical and/or horizontal directions via one or more adjustment mechanisms.

This manual boresighting of aiming light assemblies has been largely performed by trial and error. That is to say, an aiming light assembly attached to a weapon would be boresighted by coarsely adjusting the aiming beam based on an estimate made by the user for a given target distance. Then the aiming light would be activated to generate an aiming beam which was aimed at a target and several rounds of ammunition would be fired at the target. If the ammunition did not hit the target coincident with the location of the aiming beam on the target, a boresighting adjustment would be made and the process repeated until the aiming beam was accurately boresighted. Other types of manual boresighting techniques are known. Manual boresighting techniques are time consuming which is obviously an undesirable drawback. Other drawbacks also exist.

SUMMARY OF THE INVENTION

In order to overcome these and other drawbacks of the prior art, it is an object of the present invention to provide an automated boresighting device for use with an aiming light assembly. It is a feature of the present invention to provide a computer means and a servo means for adjusting the aiming light assembly upon determination of a range from the aiming light assembly to a target. It is an advantage of this invention that the aiming light assembly can be automatically adjusted corresponding to the range determination.

According to one embodiment of the present invention, there is provided an automated boresighting apparatus and method. In operation, appropriate information is entered and/or prestored in a memory and used to calculate ballistic characteristics of the weapon and ammunition. Based on this, and a range determination (automatic or manual) the elevation of the aiming light assembly (or a portion thereof) is automatically adjusted.

According to another embodiment of the present invention, a device is provided comprising a housing attached to a weapon, aiming means and range determination means enclosed in the housing for generating a beam in a direction toward a target and for determining the range from the aiming means to the target, respectively, and adjustment means responsive to the range determination means for adjusting the aiming means.

Other objects, features and advantages of this invention will become apparent when the preferred embodiment is described.

DETAILED DESCRIPTION OF THE PREFERRED EMBODIMENTS

Figure 1:
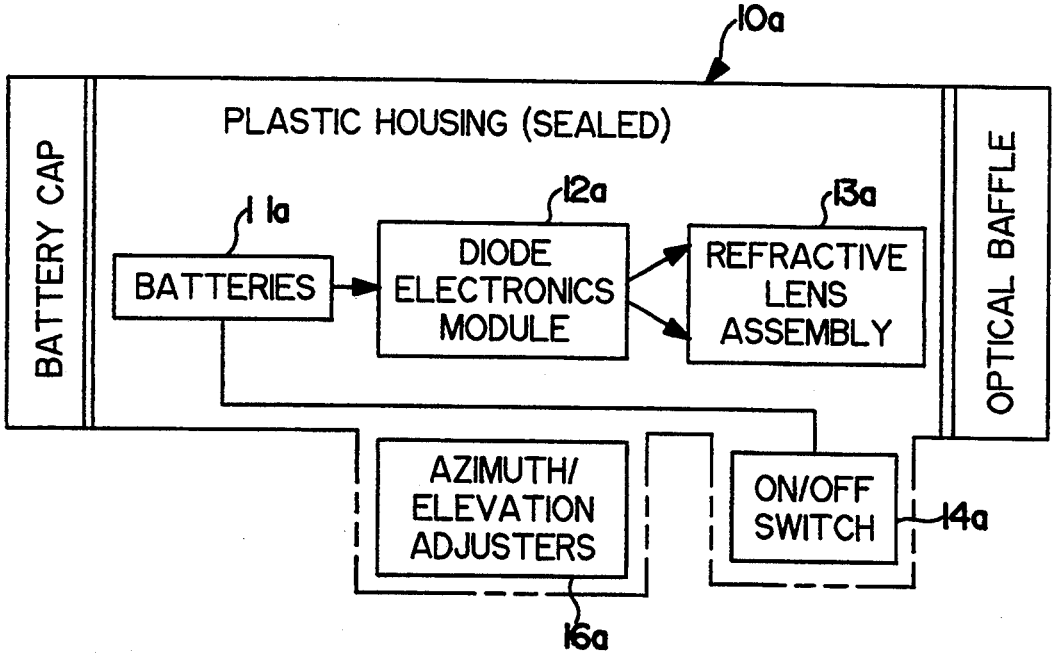
FIGS. 1 and 1*a* are examples of an aiming light assembly.
Figure 1A:
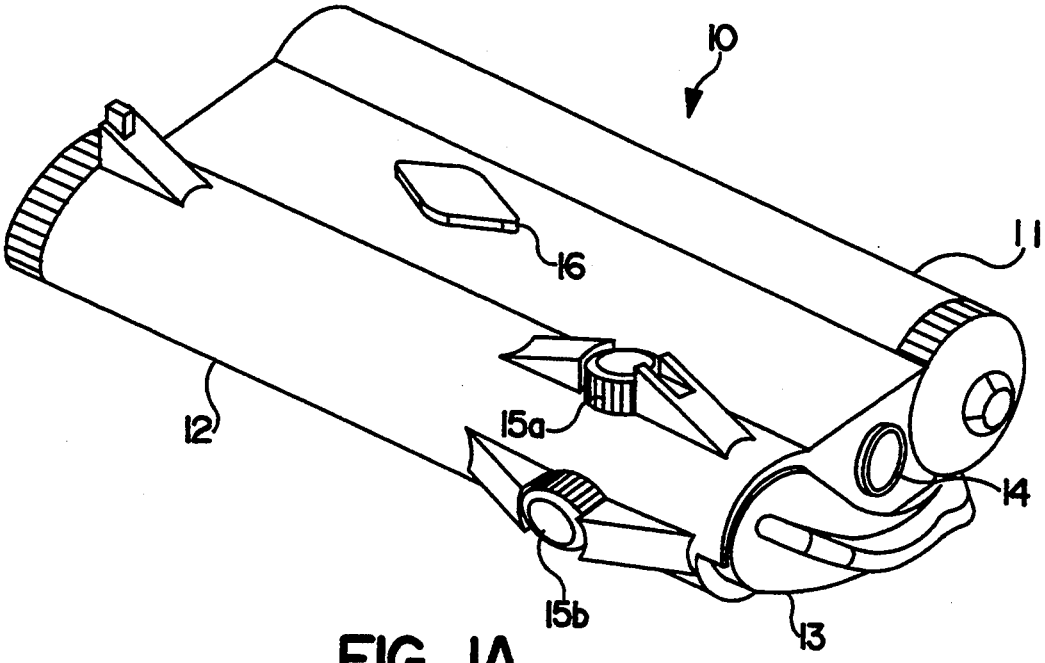
Figure 2:
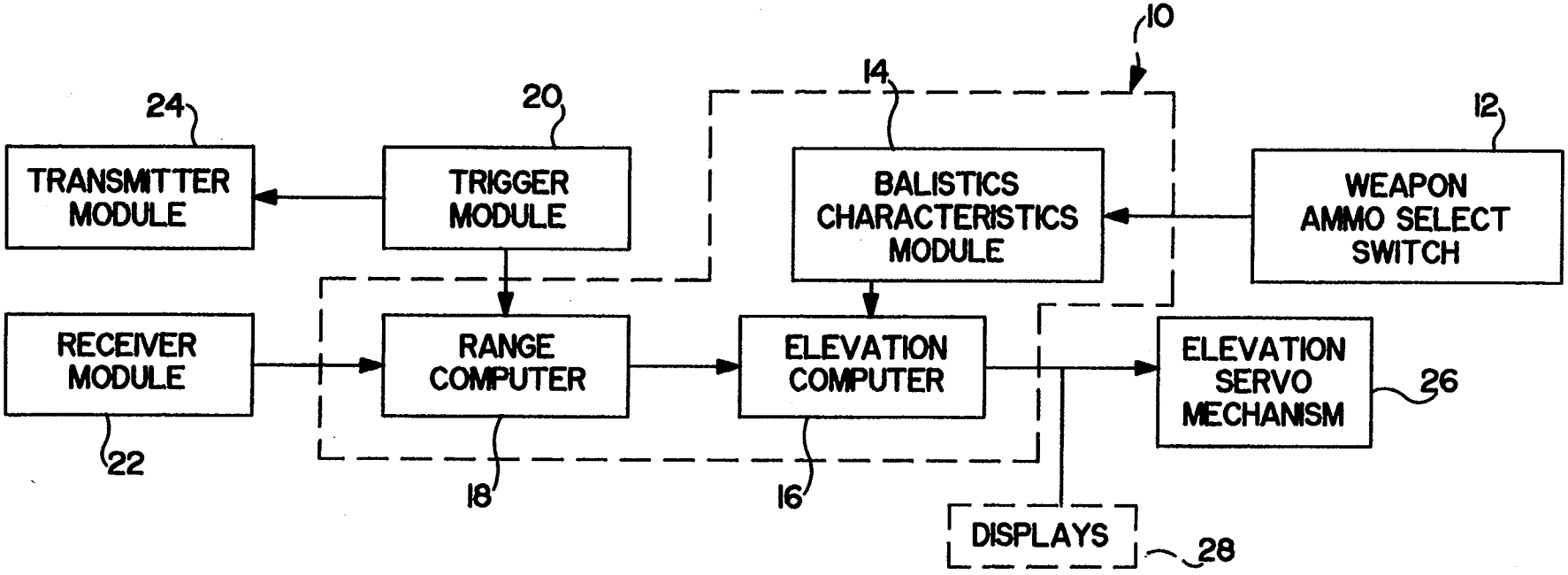
FIG. 2 is a block diagram of the automated boresighting device according to one embodiment of the present invention.

FIG. 2 is a block diagram of the automated boresighting aiming device according to one embodiment of the present invention. The automated boresighting aiming device according to this embodiment includes a controller generally indicated by reference numeral 10. Controller 10 comprises ballistics characteristics module (BCM) 14, an elevation computer 16 and a range computer 18. The BCM 14 is operatively connected to an input device 12 which enables various parameters to be input to the BCM 14. For example, these parameters may include parameters which relate to characteristics of the weapon, the ammunition, the mounting location and orientation of the automated boresighting aiming device relative to the muzzle of the weapon and other parameters needed to enable the ballistic trajectory of ammunition fired from the weapon to be calculated. The automated boresighting aiming may have data input at the factory, arms room or maintenance facility or may have one or more switches or input keys by which the operator may designate the parameters to the BCM 14. Alternatively, an insertable memory device may be used for inputting these parameters to the BCM 14. The BCM 14 calculates the ballistic trajectory of the ammunition according to well known physical formulas and/or empirical data. An output of the BCM 14 is provided as an input to elevation computer 16.

Elevation computer 16 also receives an input from range computer 18. Range computer 18 receives inputs from a trigger module 20 and a receiver module 22. Also connected to the trigger module 20 is a transmitter module 24. The elevation computer 16 provides an output to elevation servo mechanism 26 and optionally to one or more display devices 28. Preferably, the transmitter module 24 is used to generate both the aiming beam and the signal for range determination. However, it is also possible to use two separate sources for the aiming beam and range determination, both of which may be enclosed in the same housing attached to the weapon.

If separate sources for the aiming beam and the range determination beam are employed, trigger module 20 may comprise one switch to activate both devices or multiple switches each for activating a separate device. In the situation in which one switch is used, the switch must provide three modes of operation corresponding to an off mode, an aiming beam activation mode and a range determination signal activation mode. Various devices may be employed to provide the switch with three modes of operation. For example, a push-button device may be provided wherein each activation of the button changes the current mode of operation. The changes may then be cyclical whereby off mode, aiming beam activation mode and range determination signal activation mode become the current mode of operation in order. Alternatively, a sliding switch may be provided wherein three resting positions corresponding to each of the three modes of operation are provided. Still another embodiment may provide only two resting positions corresponding to the off mode and the aiming beam activation mode. The range determination signal activation mode may be activated in that embodiment by sliding the switch from the aiming beam activation mode resting position in a direction opposite the off mode resting position. A spring means may be provided such that upon its release, the switch will automatically return to the aiming beam activation mode resting position. Other embodiments for providing the three modes of operation are within the scope of the invention as well.

In operation, the transmitter module 24 emits a signal in response to activation of the trigger module 20 of the aiming light assembly. For example, when the trigger (e.g. an electromechanical switch) of the trigger module 20 is placed in the ranging determination activation mode, a pulse train of laser energy is emitted from the transmitter module 24 and is aimed at a target. At least a portion of this pulse train is then reflected from the target and received by the receiver module 22. The time of flight (i.e. the time for the laser energy to travel to the target and return) is determined by the range computer in a known manner and is used to calculate the target range. For example, a signal may be sent from trigger module 20 to range computer 18 upon activation of the trigger. This may start a timer which terminates upon receipt of a signal which is provided by the receiver module 22 to the range computer 18 upon receipt of the reflected pulse train by the receiver module 22. Based on the time of travel of the pulse train and its velocity the target range may be calculated in a known manner directly responsive to the receipt of the reflected pulse train. Based on the target range information provided by the range computer 18 and the ballistic information supplied by the BCM 14, the elevation computer 16 determines the required elevation angle for automatically boresighting, or zeroing, the aiming device with the weapon for the target range. When the device is located on top of a weapon, this will be a vertical adjustment of the aiming light assembly. However, it is to be understood that depending on the orientation of the aiming light assembly, the adjustment direction may differ. For example, if the device is rotated 90° from the aforementioned position, it may be necessary or desirable to provide a second servo motor which is operable to adjust the transmitter module.

Based on the computed elevation, one or more servo motors **26*a* of the elevation servo mechanism 26 automatically adjust the transmitter module to achieve the boresighting, or zeroing, in direct response to the range determination. For example, the servo may position the transmitter module 24 such that its output will be at the proper elevation angle relative to the ballistic trajectory of ammunition fired from the weapon so that the aiming beam is boresighted for the specific target distance or range. Optional displays 28** provide a visual display of information such as range to target distance, whether the device is zeroed, and/or the range for which the aiming light is zeroed. This display may further provide a visual indication or even an attached audio alarm (not shown) when the range to the target distance and the range for the aiming light become equal, i.e., when the servo-adjustment mechanism has adjusted the aiming beam according to the elevation computer determination. Other desired information may also be displayed if desired.

Figure 3:
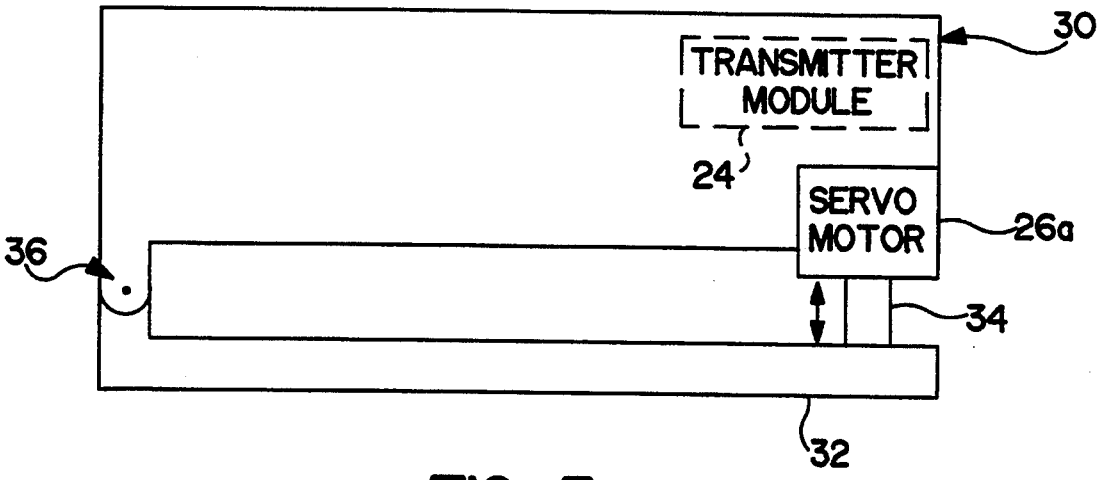
FIG. 3 is an example of one embodiment of a servo mechanism for use with the assembly of FIG. 2.
Figure 4:
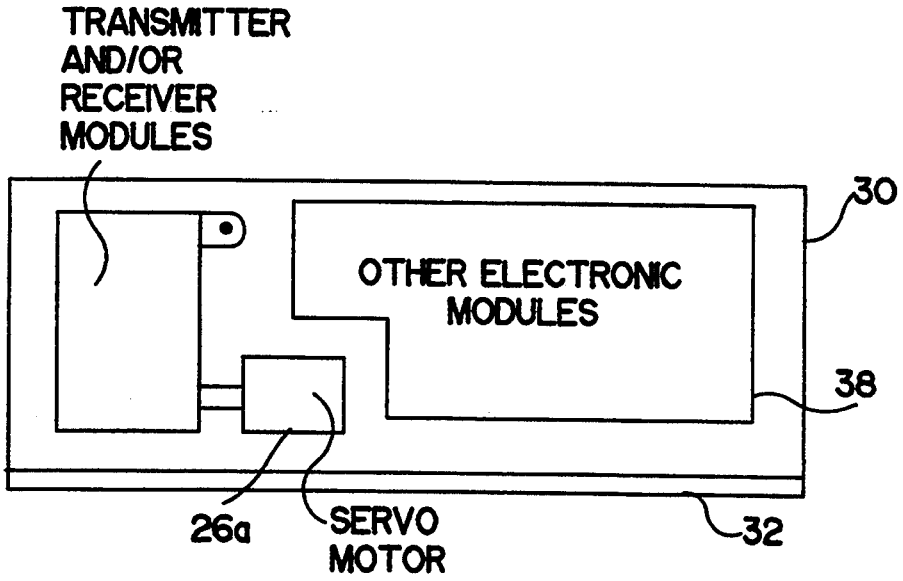
FIG. 4 is an example of an alternative embodiment of a servo mechanism for use with the assembly of FIG. 2.

FIGS. 3 and 4 are preferred alternative embodiments showing one servo motor **26*a* of elevation servo mechanism 26 and its connection to other components. FIG. 3 shows the servo motor 26*a* in an external adjustment embodiment. In this embodiment, at least the electro-optics assembly 30 of the aiming light which includes the transmitter module 24, is adjusted by the servo motor 26*a* relative to a mounting base 22 based on the calculated elevation. Preferably, the servo motor 26*a* is connected to a telescoping shaft 34 which in turn is connected to one end of the electro-optics assembly 30 and to the base 32. Another end of the electro-optics assembly 30 is pivotably connected to the base 32 via a hinge 36** or some other mechanical arrangement which enables the desired adjustment.

In an alternative embodiment (FIG. 4), at least one servo motor **26*a* may be mounted internally of the electro-optics assembly 30 and may move only a limited number of components relative to the electro-optics assembly housing which has an integral mounting base 32 or which is fixed relative to the base 32. For example, as shown in FIG. 4, at least one servo motor 26*a* may adjust the elevation of the transmitter and receiver modules (24, 22**).

Other embodiments of the externally or internally mounted servo are also possible within the scope of the invention. For example, movement of the transmitter module 24 alone or in combination with other modules is also feasible and within the scope of the invention. As stated above, two servo motors may be used to enable adjustment in more than one direction. For example, it may further be desired to adjust the horizontal position of the aiming beam produced by transmitter module 24 to account for cross wind. To accomplish this, the wind speed and direction may be entered into the controller (or it may be sensed) and an appropriate adjustment of the transmitter module 24 may be made to account for the wind.

To achieve automated boresighting according to a preferred embodiment, the operator performs the following steps after the device has been properly mounted on the weapon. First, the operator enters the necessary parameters for the BCM 14 to calculate the ballistic trajectory. This is done by manipulating the weapon and ammo select switch 12 for the weapon and ammunition being used and/or using other parameter input keys. Alternatively, the input can be made through an insertable memory device having this information already stored thereon. Next, the operator turns on the laser, positions the laser beam on the target and "triggers" the laser by activating the range trigger. When on, the device emits a continuous or pulsing laser beam suitable for aiming a weapon in a known manner. When triggered, a unique pulse is emitted which can be distinguish by the receive module, and an event clock is stopped. When the laser is triggered, a unique pulse form is emitted and the range computer begins measuring the time of flight. This unique pulse train can be distinguish by the receiver module and upon receipt of the reflected energy of the unique pulse train, the time of flight clock is stopped. The elapsed time between emission and receipt of the unique pulse is used to calculate target range. Based on the entered parameters, the BCM 14 calculates the ballistic trajectory. Based on the calculated trajectory and range, the controller 10 sends control signals to the servo mechanism 26. Then, the transmitter module 24 (alone or with other modules) is adjusted by the servo motor 26*a* so that the laser beam is boresighted to the weapon for the target range.

Optical displays 28 provide range to target information and/or indicate that the device has been zeroed. The indicator that the device has been zeroed can be a simple indicator light or a digital readout displaying the range for which the device is zeroed. Once boresighted, the operator can position the laser beam on the target and fire the weapon to cause the ammunition to strike the desired target. These steps may be repeated for additional targets located at different ranges.

The foregoing is a description of the preferred embodiments of the present invention. Various modifications and substitutions will be readily apparent to one of ordinary skill in the art. The invention is only limited by the claims appended hereto. For example, the transmitter module is not limited to a device which generates laser radiation. Other optical or electromagnetic signals may be used for range determination. The aiming beam may be visible or invisible (e.g. infrared light used in conjunction with night vision goggles).

In addition, a simplified version of this device in which range to target is provided as an operator input and the automatic boresighting device directs the aiming light beam based on ballistic calculations is also envisioned.

I claim:

1. An automated boresighting aiming device for use with a weapon comprising:

aiming signal transmitter means for directing an aiming beam at a target;

range determination means for determining the range from said aiming signal transmitter means to the target and generating a range signal; and zeroing means responsive to said range signal for automatically adjusting the aiming signal transmitter means to adjust the beam directed from said aiming signal transmitter means to said target.

2. The device according to claim 1 wherein said zeroing means comprises means for computing an elevation angle for said aiming signal transmitter based on said range signal.

3. The device according to claim 2 further comprising ballistic trajectory determining means for determining a predicted ballistic trajectory of a projectile fired from said weapon and generating ballistic trajectory information for use by said zeroing means in computing said elevation angle.

4. The device according to claim 3 wherein said zeroing means comprises a computer means responsive to said range signal and said ballistic trajectory information for computing an elevation angle and a servo means for automatically adjusting said aiming signal transmitter means in response to said computed elevation angle.

5. The device according to claim 1 further comprising a display means for displaying the range of said automated boresighting aiming device to said target as determined by said range determination means.

6. An automated boresighting aiming device for use with a weapon comprising:

an aiming light assembly comprising means for emitting an aiming beam from said assembly to a target and range determining means for determining the range of said target; and adjustment means responsive to said range determining means for automatically adjusting said aiming beam to boresight said aiming light assembly to said weapon for said determined range.

7. The device according to claim 6 wherein said adjustment means is directly responsive to said range determination means.

8. The device according to claim 6 wherein said adjustment means adjusts the elevation of a beam emitted from said aiming light assembly relative to said weapon.

9. The device according to claim 6 further comprising switch means for operating said aiming light assembly and said range determining means.

10. The device according to claim 6 wherein said switch means comprises a single switch actuator which enables operation of said aiming light and range determining means in a single step.

11. The automated boresighting device according to claim 6 further comprising display means for displaying the determined range from said aiming means to the target.

12. An automated boresighting aiming device for use with a weapon comprising:

an aiming light assembly for directing an aiming beam to a target;

means for determining and displaying the range from said aiming light assembly to the target;

means for determining whether said aiming light assembly is zeroed for the displayed range;

and means for adjusting said aiming beam if the aiming light assembly is not zeroed for the displayed range.

13. An automated boresighting aiming device for use with a weapon comprising:

a housing attachable to said weapon;

an aiming light assembly located substantially within said housing for directing an aiming beam at a target for aiming the weapon; and range determination means located substantially within said housing for determining the range from said weapon to the target.

14. The device of claim 13 further comprising means for automatically adjusting said aiming light assembly responsive to said range determined by said range determination means.

15. A method for boresighting an aiming light which may be attached to a weapon, said method comprising the steps of:

(a) determining the range from said aiming light to the target;

(b) generating a range signal based on the determination in step (a);
(c) providing an aiming beam for aiming said weapon at said target;
(d) adjusting said aiming beam based on said range signal; and
(e) directing said aiming beam at said target to aim said weapon for the range determined in step (b).

16. The method of claim 15 further comprising the steps of:
(f) generating a ballistic trajectory signal;
(e) computing an elevation angle based on said range signal and ballistic trajectory signal; and
(f) adjusting said aiming beam based on said computed elevation angle.

* * * * *